US012583029B2

(12) United States Patent
Ozawa et al.

(10) Patent No.: US 12,583,029 B2
(45) Date of Patent: Mar. 24, 2026

(54) CORNER HEAD STRUCTURE, A RIVETING TOOL WITH THE CORNER HEAD STRUCTURE

(71) Applicant: NEWFREY LLC, New Britain, CT (US)

(72) Inventors: Masahito Ozawa, Toyohashi (JP); Tohru Nagayama, Toyohashi (JP)

(73) Assignee: Newfrey LLC, New Britain, CT (US)

( * ) Notice: Subject to any disclaimer, the term of this patent is extended or adjusted under 35 U.S.C. 154(b) by 0 days.

(21) Appl. No.: 18/737,234

(22) Filed: Jun. 7, 2024

(65) Prior Publication Data

US 2024/0408667 A1 Dec. 12, 2024

(30) Foreign Application Priority Data

Jun. 9, 2023 (JP) ..... 2023-095698

(51) Int. Cl.
*B21J 15/30* (2006.01)
*B21J 15/10* (2006.01)

(52) U.S. Cl.
CPC ..... *B21J 15/30* (2013.01); *B21J 15/105* (2013.01)

(58) Field of Classification Search
None
See application file for complete search history.

(56) References Cited

U.S. PATENT DOCUMENTS 2,053,717 A * 9/1936 Huck ..... B21J 15/045 72/450
2,053,720 A * 9/1936 Huck ..... B21J 15/045 123/183.1
3,374,656 A * 3/1968 Di Maio ..... B21J 15/105 60/473

(Continued)

FOREIGN PATENT DOCUMENTS

DE 2607263 A1 9/1976
DE 202023101396 U1 4/2023

(Continued)

OTHER PUBLICATIONS

EP Search Report Dated Oct. 25, 2024, cited in corresponding EP Patent Application No. 24178930.4.

(Continued)

*Primary Examiner* — Tanzim Imam
(74) *Attorney, Agent, or Firm* — Harness, Dickey & Pierce, P.L.C.

(57) ABSTRACT

A corner head includes a driving body, a driven body, a bell crank, and a support pin. The driving body and the driven body both include a guiding portion. The bell crank includes first and second guided portions and is rotatable about the support pin. The guided portions are slidable within the respective guiding portions of the driving body and the driven body. When the driving body is moved in a first direction, the first guided portion is guided by the guiding portion of the driving body and moves in a second direction perpendicular to the first direction; the bell crank rotates (Continued)

about the support pin; the second guided portion is guided by the guiding portion of the driven body and moves in a third direction different from the second direction; and the driven body moves in a fourth direction perpendicular to the third direction.

13 Claims, 7 Drawing Sheets

(56) References Cited

U.S. PATENT DOCUMENTS

| | | | | | |
|---|---|---|---|---|---|
| 3,760,627 | A | * | 9/1973 | Richardson | B21J 15/386 29/243.523 |
| 3,898,833 | A | * | 8/1975 | Richardson | B21J 15/22 29/243.525 |
| 3,981,177 | A | * | 9/1976 | Di Maio | B21J 15/105 72/453.01 |
| 4,815,310 | A | | 3/1989 | Summerlin et al. | |
| 4,924,691 | A | | 5/1990 | Summerlin et al. | |
| 5,376,027 | A | | 12/1994 | Hergenrather | |
| 5,699,762 | A | * | 12/1997 | Horiuchi | F01L 3/20 123/90.22 |
| 10,532,396 | B2 | | 1/2020 | Olsson | |

FOREIGN PATENT DOCUMENTS

| | | | |
|---|---|---|---|
| GB | 794932 | A | 5/1958 |
| JP | S52111072 | A | 9/1977 |
| JP | S5665910 | A | 6/1981 |
| JP | S5670506 | A | 6/1981 |
| JP | S63264233 | A | 11/1988 |
| JP | 4834418 | B2 | 12/2011 |
| JP | 6820022 | B2 | 1/2021 |

OTHER PUBLICATIONS

PRH850 Operating Instructions dated Feb. 1984.
PRH840 Operating Instructions dated Feb. 1989.
Communication mailed Oct. 24, 2025, in corresponding European Application No. 24178930.4.

* cited by examiner

CORNER HEAD STRUCTURE, A RIVETING TOOL WITH THE CORNER HEAD STRUCTURE

CROSS-REFERENCE TO RELATED APPLICATIONS

This application claims priority from Japanese Patent Application No. 2023-095698, filed on Jun. 9, 2023, the entire disclosure of which is incorporated herein by reference.

BACKGROUND OF THE PRESENT INVENTION

The present invention relates to the structure of a corner head. In particular, it relates to the structure of a corner head that converts the direction of the force that pulls a rivet into different directions.

A rivet tool is used to fasten members together using rivets. When fastening a rivet using a rivet tool in a narrow space, the tip of the rivet tool does not enter the narrow space and the rivet cannot be pulled, so that a corner head is used in the rivet tool to convert the direction of the rivet pulling force into different directions. For example, a corner head that converts by 90 degrees is used.

In general, with rivet tools, a bell crank mechanism is well-known as a corner head mechanism for converting the direction of a rivet pulling force into different directions. Specifically, the bell crank mechanism is equipped with a driving body, a bell crank, and a driven body. The bell crank is plate-shaped, comprises two elongated holes, and comprises a hole for allowing passage of a support pin. The bell crank is rotatable about the axis of the support pin. The driving body is coupled to one of the two elongated holes of the bell crank via a pin, and the driven body is coupled to the other of the two elongated holes of the bell crank via another pin.

In such a corner head bell crank mechanism, when the driving body is pulled in a certain direction, the pulling force is transmitted to the inner wall of the elongated hole to which the driving body of the bell crank is coupled. Then, this transmission of pulling force rotates the bell crank about the axis of the support pin. Furthermore, such rotation causes the pulling force to be transmitted to the inner wall within the elongated hole to which the driven body of the bell crank is coupled.

Finally, due to this transmission of pulling force, the pulling force is transmitted to the driven body from the inner wall in the elongated hole to which the driven body of the bell crank is connected, and the force that pulls the driven object acts in a direction different from the direction of the force pulling the driving body. By using a corner head equipped with such a bell crank mechanism, the direction of the force applied to pull the rivet by the rivet tool can be changed to a different direction.

In the above-described operation, such a bell crank mechanism locally applies stress to the inner walls of the two elongated holes of the bell crank, by respective sliding of the pin connecting the driving body and the bell crank and the other pin connecting the bell crank and the driven body on the inner walls in the two corresponding elongated holes of the bell crank. Such local stress causes problems such as insufficient durability of the bell crank, and when using a corner head for a rivet with a high mandrel break-load, the strength of the bell crank becomes insufficient.

Therefore, in a corner head used for fastening rivets in a narrow space, there is a need for a structure capable of achieving a higher level of durability than that achieved with conventional bell crank mechanisms and that can be used within the limited space inside the corner head.

SUMMARY OF THE INVENTION

Therefore, the problem to be solved by the present invention is to provide a corner head that is more durable than conventional corner heads.

The present invention was developed to solve such problems; one embodiment of the present invention is configured so that the corner head structure is equipped with a driving body, a driven body, a bell crank, and a support pin; wherein the driving body and the driven body comprise a guiding portion; the bell crank comprises first and second guided portions and is rotatable about the axis of the support pin; the first and second guided portions are in slidable contact with the guiding portion of the driving body and the guiding portion of the driven body, respectively, and when the driving body is moved in the first direction, the first guided portion is guided by the guiding portion of the driving body and moves in a second direction perpendicular to the first direction; the bell crank rotates about the axis of the support pin; the second guided portion is guided by the guiding portion of the driven body and moves in a third direction different from the second direction; and the driven body moves in a fourth direction perpendicular to the third direction. With such a configuration, it is possible to provide a highly durable corner head, since stress is applied dispersedly to the first and second guided portions, whereas stress is applied locally to the inner wall of the elongated hole part of the conventional corner head. Further, with such a configuration, it is possible to provide a corner head that can be used for fastening rivets closer to a wall surface than with conventional corner heads. Moreover, with such a configuration, it is possible to provide a corner head that can pull a rivet over a longer distance with one pulling operation and is able to handle rivets that require a large pulling distance than with conventional corner heads.

In another embodiment, the corner head structure is configured so that the bell crank comprises a bell crank body, and the bell crank body is coupled to the first and second guided portions via first and second connecting pins, respectively. With such a configuration, it is possible to provide a highly durable corner head, since stress is dispersed to the first and second guided portions, whereas stress is applied locally to the inner wall of the elongated hole part of the conventional corner head. Also, with such a configuration, it is possible to provide a corner head that is usable for fastening rivets closer to a wall surface than with conventional corner heads. Furthermore, with such a configuration, it is possible to provide a corner head capable of pulling a rivet over a longer distance with one pulling operation and capable of handling rivets that require a large pulling distance than with a conventional corner head.

In another embodiment, the corner head structure is configured so that a certain surface of the first guided portion is in slidable surface contact with a guiding portion of the driving body, and a certain surface of the second guided portion is in slidable surface contact with the guiding portion of the driven body. With such a configuration, the stress applied to the guided portion is dispersed on the surface that contacts the guiding portion, and as a result, a corner head that is more durable than other embodiments can be provided. In addition, with such a configuration, it is possible to provide a corner head that usable for fastening rivets closer to a wall surface than with conventional corner heads. Furthermore, with such a configuration, it is possible to provide a corner head capable of pulling a rivet over a longer distance with one pulling operation and capable of handling rivets that require a large pulling distance than with conventional corner heads.

According to the present invention, it is possible to provide a corner head that is more durable than conventional corner heads.

DESCRIPTION OF THE PREFERRED EMBODIMENTS

Hereinafter, a corner head 20 according to an embodiment of the present invention and a rivet tool 10 provided with the corner head 20 will be described with reference to the drawings.

Figure 1:
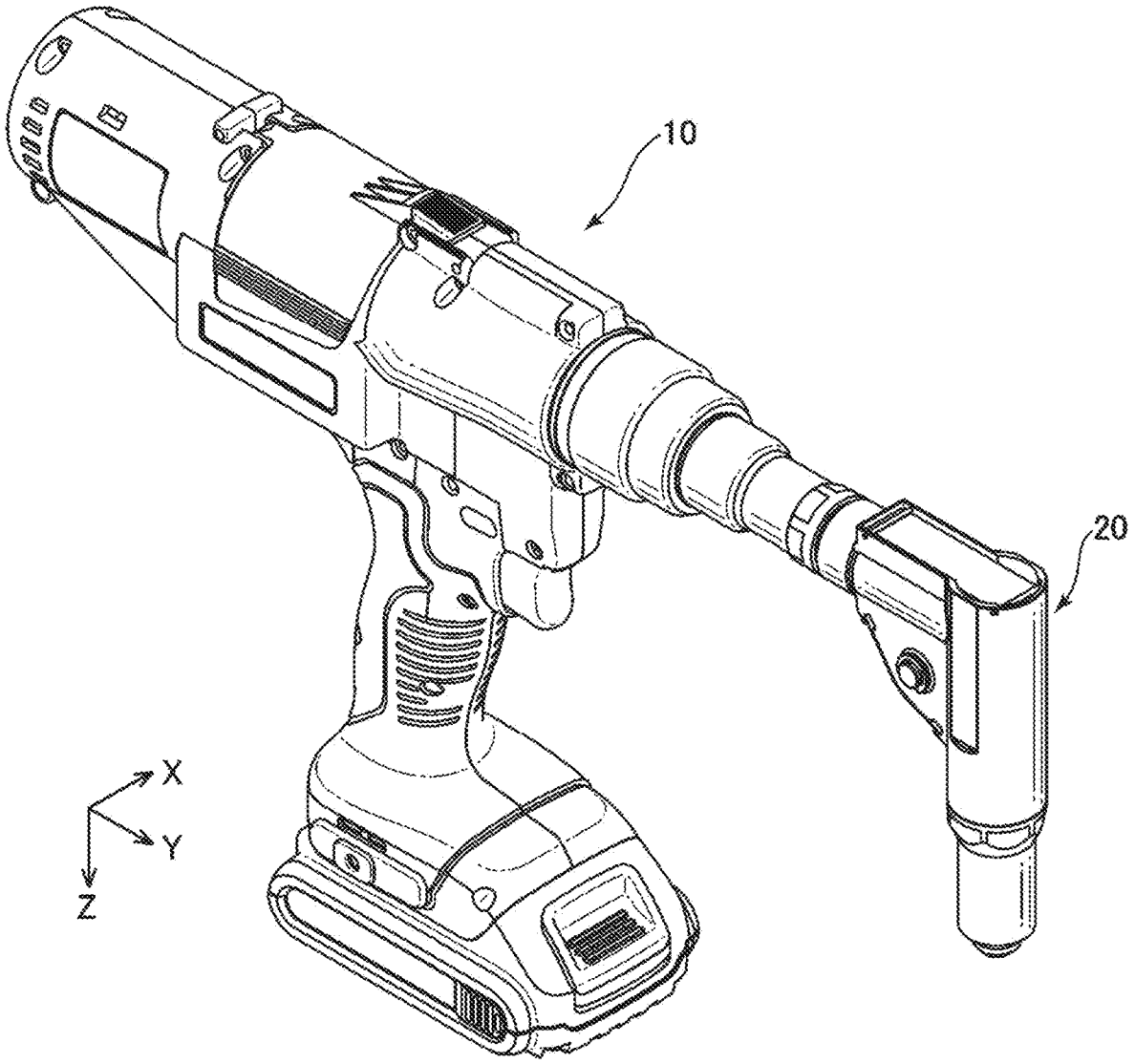
FIG. 1 is a perspective view of a rivet tool according to an embodiment of the present invention.

FIG. 1 shows a perspective view of a rivet tool 10 with a corner head 20 according to an embodiment of the present invention. The corner head 20 can be attached to and removed from the rivet tool 10. Further, the corner head 20 may be integrated with the rivet tool 10. When the corner head 20 can be attached and removed as in the present embodiment, the corner head 20 can be attached to and removed from the existing rivet tool 10. Additionally, the corner head 20 can be attached to and removed from the rivet tool 10 even if the rivet tool 10 is pneumatic, hydraulic, electric, or the like. A rivet is inserted from the tip of the nose unit 23 of the corner head 20 in the −Z direction.

Figure 2:
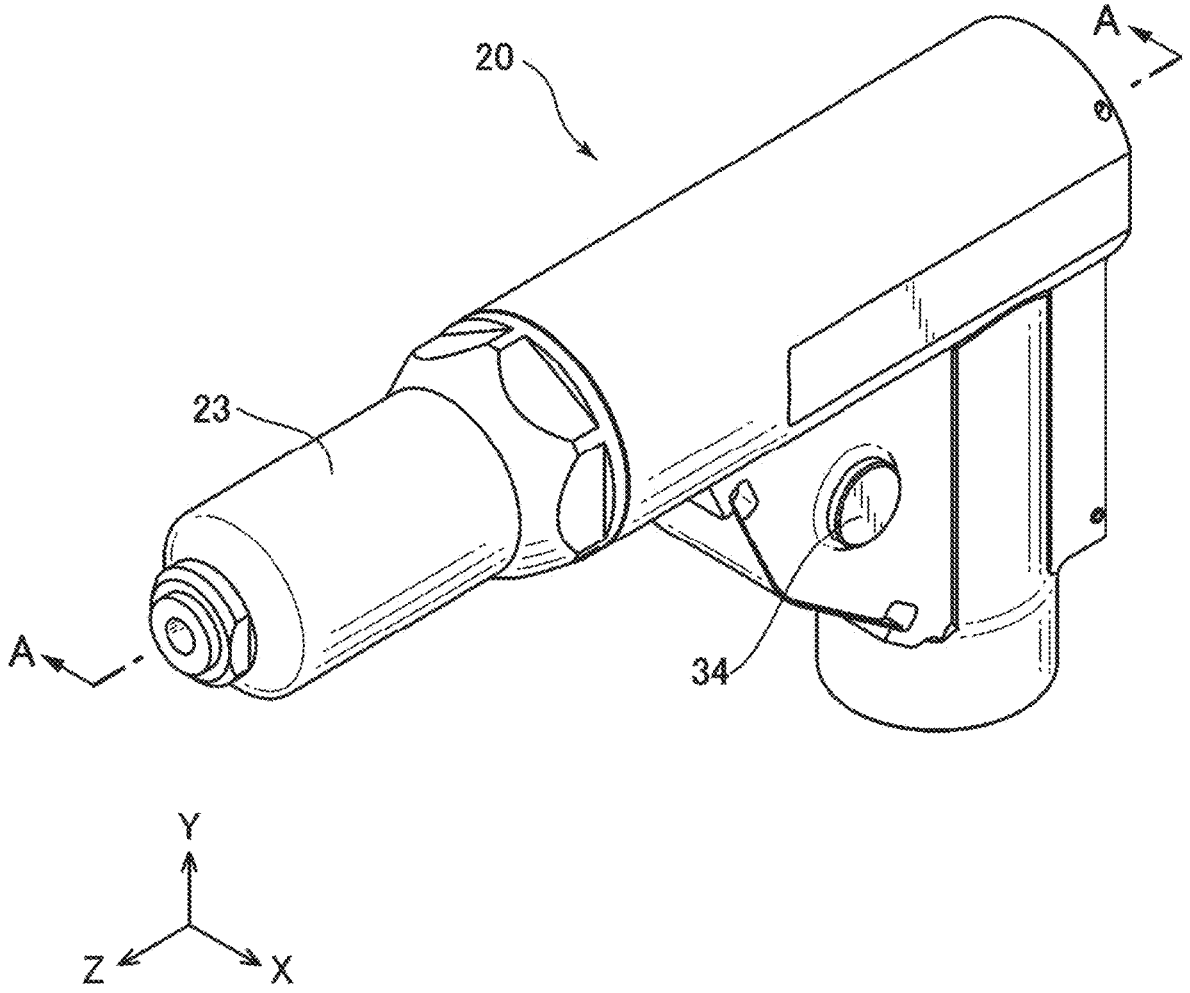
FIG. 2 is a perspective view of a corner head according to an embodiment of the present invention.
Figure 3:
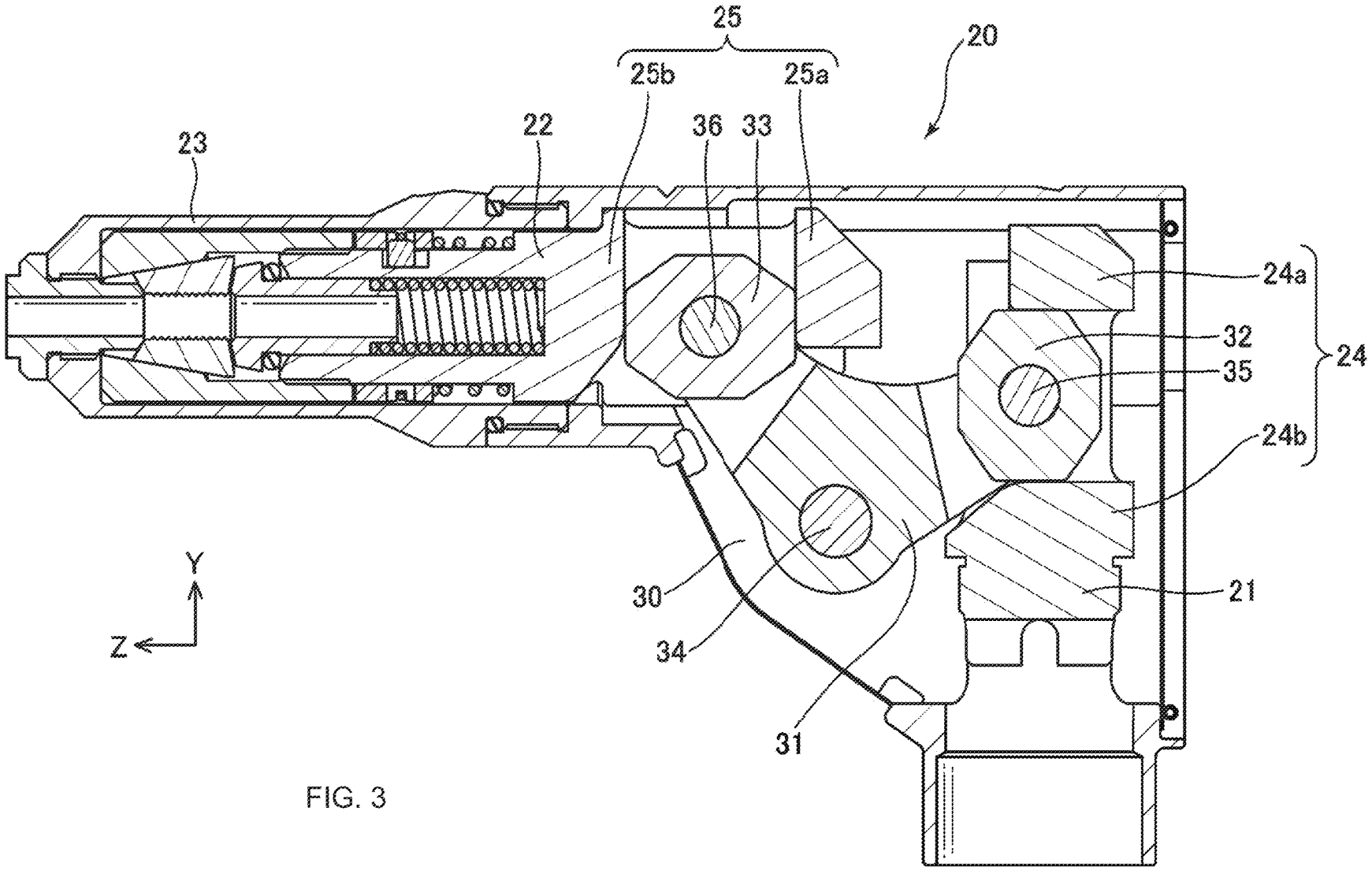
FIG. 3 is a cross-section view taken along line AA of the corner head in FIG. 2.

FIG. 2 shows a perspective view of a corner head 20 according to an embodiment of the present invention. Further, FIG. 3 shows a cross-section view of the corner head 20 in FIG. 2 taken along the line AA. The corner head 20 is equipped with a driving body 21, a driven body 22, and a bell crank 30. The driving body 21 is equipped with a guiding portion 24. The driven body 22 is equipped with a guiding portion 25. The guiding portion 24 of the driving body 21 comprises guiding portions 24*a* and 24*b*. The guiding portion 25 of the driven body 22 comprises guiding portions 25*a* and 25*b*. The bell crank 30 is equipped with a first guided portion 32 as described later, and the first guided portion 32 is configured to slidably contact at least one of the guiding portions 24*a* and 24*b* of the driving body 21. The bell crank 30 is equipped with a second guided portion 33 as described later, and the second guided portion 33 is configured to slidably contact at least one of the guiding portions 25*a* and 25*b* of the driven body 22. By using the corner head 20 of the present embodiment in the rivet tool 10, the direction of the pulling force can be changed by 90 degrees. Moreover, the angle to be converted is not limited to 90°; for example, the direction of the pulling force may be configured to be converted to an angle of 45°, 120°, or the like.

Figure 4:
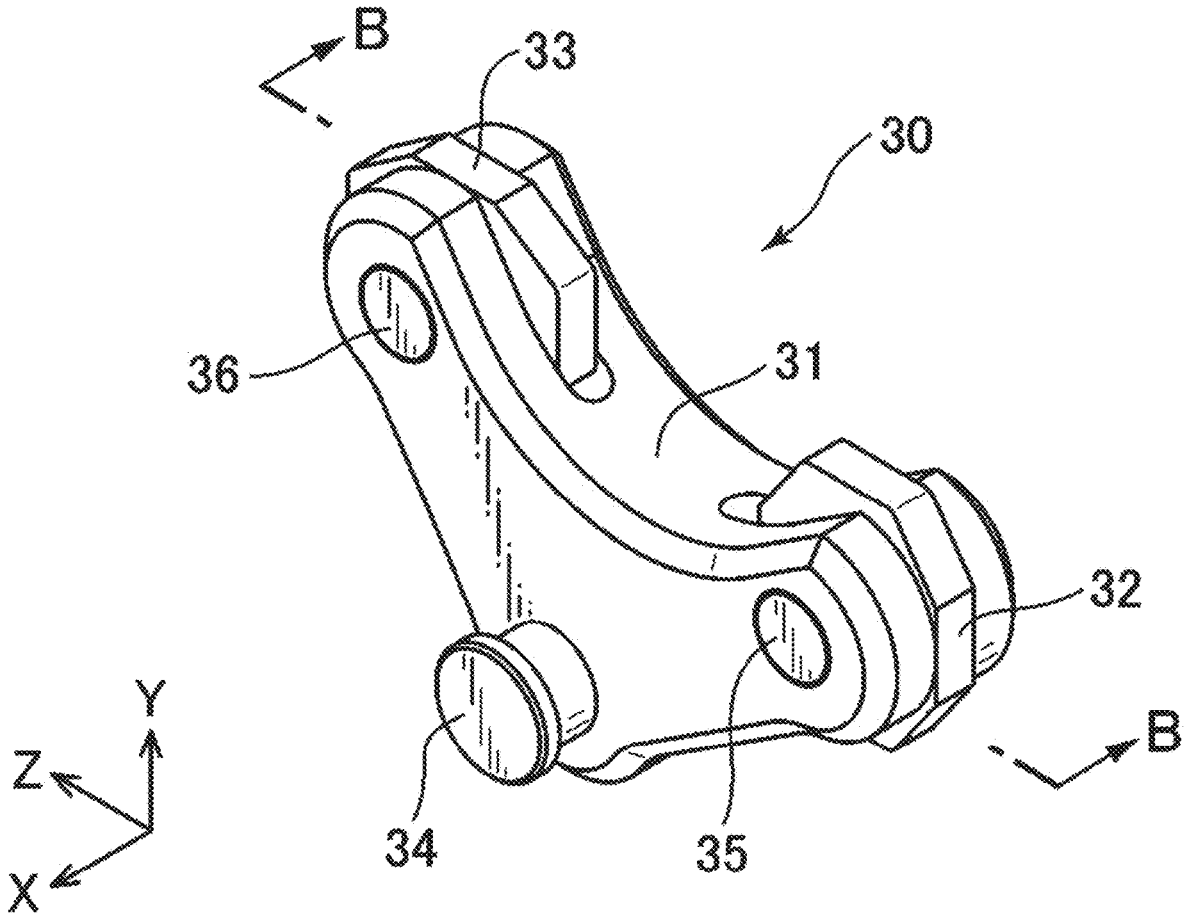
FIG. 4 is a perspective view of a bell crank of a corner head according to an embodiment of the present invention.
Figure 5:
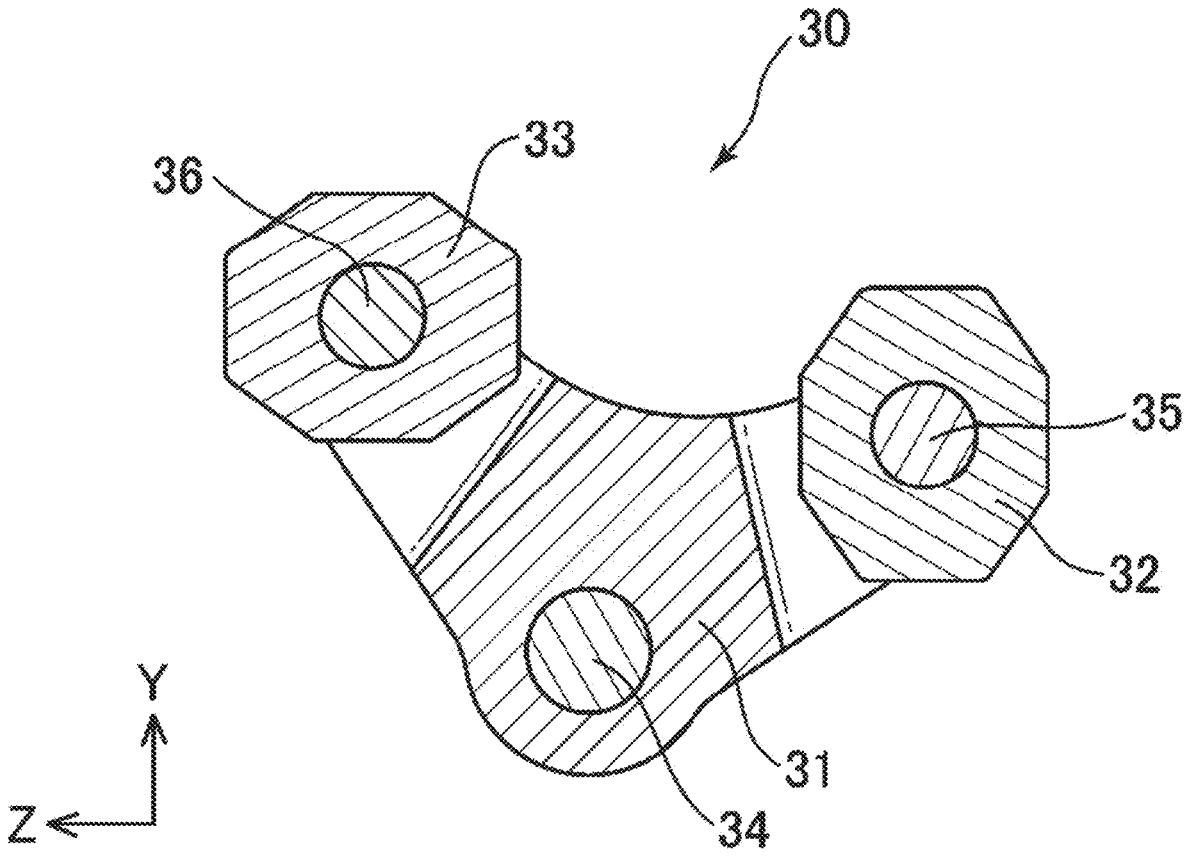
FIG. 5 is a cross-section view taken along line BB of the bell crank in FIG. 4.

FIG. 4 shows a perspective view of a bell crank 30 according to an embodiment of the present invention. Further, FIG. 5 shows a cross-section view of the bell crank 30 in FIG. 4 taken along the line BB. In the bell crank 30, a bell crank body 31 is coupled to a first guided portion 32 via a first connecting pin 35. In the bell crank 30, a bell crank body 31 is coupled to a second guided portion 33 via a second connecting pin 36. Also, in the present embodiment, the bell crank body 31, the first guided portion 32, and the second guided portion 33 are configured as an assembly as described above; however, in other embodiments, these may be constructed as one piece. In the bell crank 30, a support pin 34 is inserted through a bell crank body 31. The bell crank 30 is able to rotate about the axis of the support pin 34. Here, in FIG. 5, the bell crank body 31 shows a shaded portion and an unshaded portion; however, considering that FIG. 5 is a cross-section view taken along the line BB in FIG. 4, it can be understood that the shaded portion of the bell crank body 31 is a portion where no slit is provided, and the unshaded portion of the bell crank body 31 is a portion where a slit is provided. In addition, although the first and second guided portions 32 and 33 of the present embodiment have an octagonal shape, as long as the first guided portion 32 and the second guided portion 33 are in slidable contact with the guiding portion 24 of the driving body 21 and the guiding portion 25 of the driven body 22, their shapes do not matter.

Figure 6:
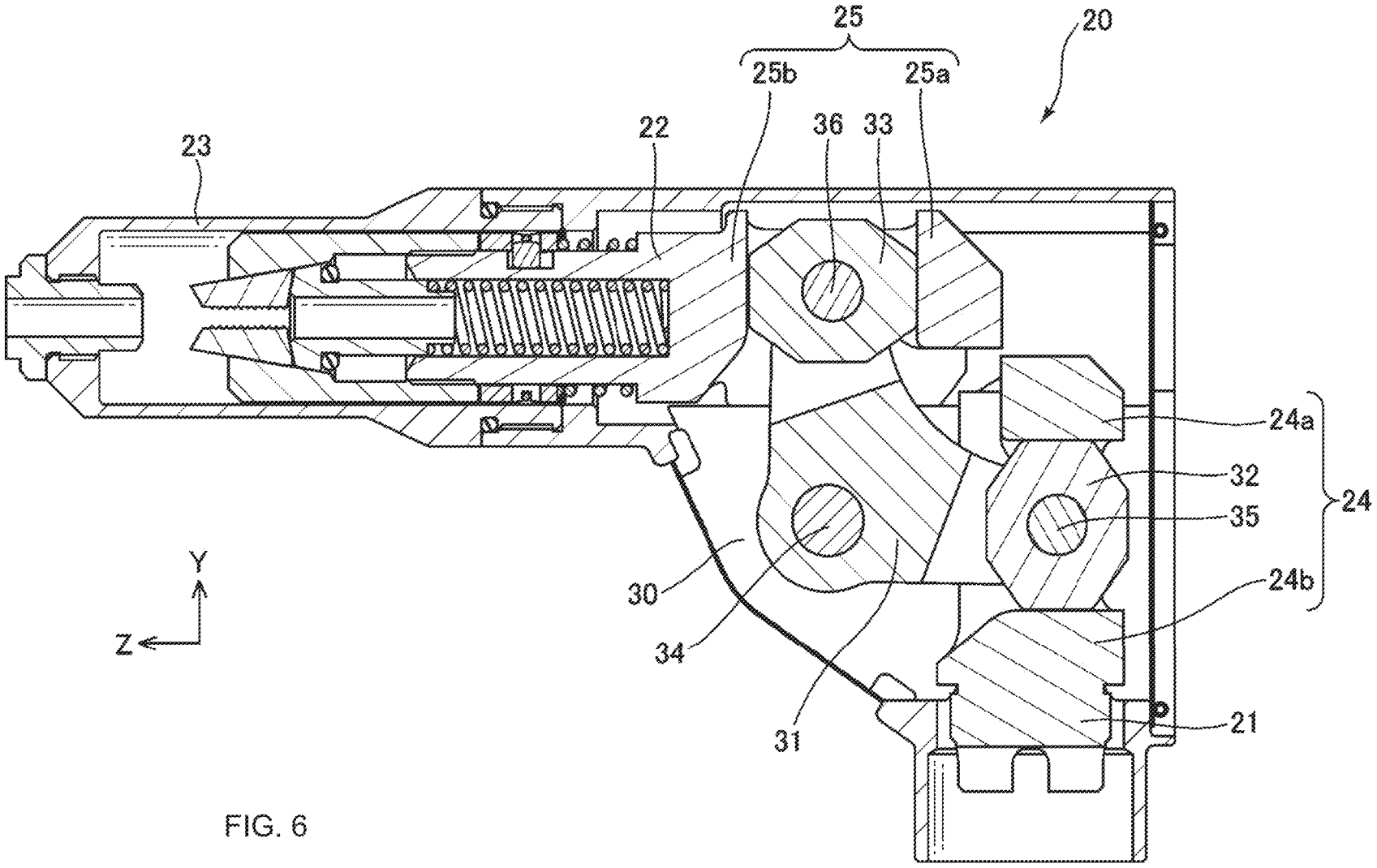
FIG. 6 is a cross-section view of a state in which the driving body is pulled in the −Y direction from the state of FIG. 3, in the middle of a rivet pulling operation.
Figure 7:
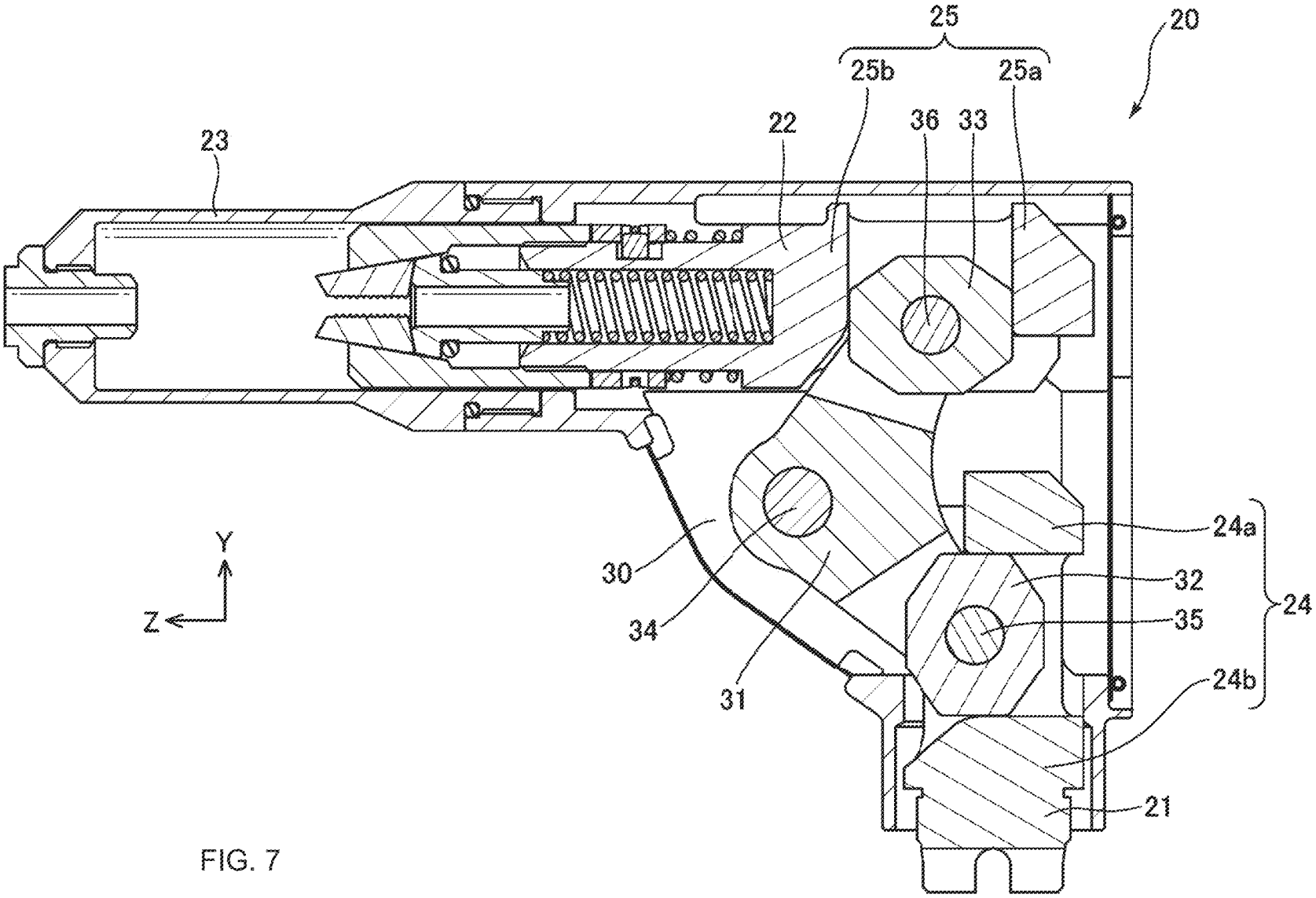
FIG. 7 is a cross-section view of a state in which the driving body is further pulled in the −Y direction from the state of FIG. 6, at the end of the rivet pulling operation.

FIGS. 3, 6 and 7 show, in the action of pulling a rivet with the rivet tool 10, the state of each component in the corner head 20 that converts a pulling force in the −Y direction into a pulling force in the −Z direction at a 90° angle. Further, the angle conversion by the corner head is not limited to 90 degrees, and may, for example, be configured to convert angles of 45 degrees, 120 degrees, and the like. FIG. 3 shows the state at the start of the rivet pulling operation, FIG. 6 shows the state in the middle of the rivet pulling operation, and FIG. 7 shows the state at the end of the rivet pulling operation. Moreover, the state shown in FIG. 7 does not necessarily indicate the end of the rivet pulling operation, and depending on the length of the target rivet, for example, the state shown in FIG. 6 may in some cases be the end of the rivet pulling action. In addition, in the state of FIG. 3, as described above, in the present embodiment, the first guided portion 32 is in contact with the guiding portions 24*a* and 24*b* of the driving body 21. At this time, the first guided portion 32 only needs to be in contact with at least the guiding portion 24*a* of the driving body 21.

FIG. 6 shows a state in which the driving body 21 is pulled in the −Y direction from the state shown in FIG. 3, in the middle of the rivet pulling operation. The operation inside the corner head 20 at this time will be described below in comparison with the state shown in FIG. 3.

The force of pulling the driving body 21 causes the driving body 21 to move in the −Y direction. Since the driving body 21 comprises guiding portions 24*a* and 24*b*, as the driving body 21 moves in the −Y direction, the guiding portions 24*a* and 24*b* of the driving body 21 similarly move in the −Y direction. In the present embodiment, since the first guided portion 32 is in contact with the guiding portions 24*a* and 24*b* of the driving body 21, by moving the guiding portions 24*a* and 24*b* of the driving body 21 in the −Y direction, the first guided portion 32 is guided by the guiding portions 24*a* and 24*b* of the driving body 21, and slides between the guiding portions 24*a* and 24*b* of the driving body 21 while moving in the −Z direction perpendicular to the −Y direction. Also, the first guided portion 32 may be configured to contact only the guiding portion 24*a*, which is one of the guiding portions 24*a* and 24*b* of the driving body 21, and slide only with the guiding portion 24*a* while moving in the −Z direction perpendicular to the −Y direction.

By movement in the −Z direction of the first guided portion 32, the bell crank 30, which is connected to the first guided portion 32 via the first connecting pin 35, is rotated clockwise when viewed in the direction toward the page (−X direction, referring to FIG. 4). about the axis of the support pin 34. As the bell crank 30 rotates, force is transmitted to the second guided portion 33 in the −Z direction.

By transmitting the force in the −Z direction to the second guided portion 33, in the present embodiment, the second guided portion 33 is in contact with the guiding portions 25*a* and 25*b* of the driven body 22, so that force is transmitted from the second guided portion 33 to the guiding portion 25*a* of the driven body 22 in the −Z direction. Therefore, the guiding portions 25*a* and 25*b* of the driven body 22 move in the −Z direction. At this time, the second guided portion 33 is guided by the guiding portions 25*a* and 25*b* of the driven body 22, and slides between the guiding portions 25*a* and 25*b* of the driven body 22, while moving in the +Y direction perpendicular to the −Z direction. Further, the second guided portion 33 is configured so that it contacts only the guiding portion 25*a*, which is one of the guiding portions 25*a* and 25*b* of the driven body 22, and slides only on the guiding portion 25*a* while moving in the +Y direction perpendicular to the −Z direction.

Since the driven body 22 comprises guiding portions 25*a* and 25*b*, the driven body 22 similarly moves in the −Z direction as the guiding portions 25*a* and 25*b* move in the −Z direction.

FIG. 7 shows a state in which the driving body 21 is further pulled in the −Y direction from the state shown in FIG. 6, at the end of the rivet pulling operation. The operation inside the corner head 20 at this time will be described below in comparison with the state shown in FIG. 6.

The force of pulling the driving body 21 causes the driving body 21 to further move in the −Y direction. Since the driving body 21 comprises guiding portions 24*a* and 24*b*, as the driving body 21 further moves in the −Y direction, the guiding portions 24*a* and 24*b* of the driving body 21 similarly move further in the −Y direction. In the present embodiment, since the first guided portion 32 is in contact with the guiding portions 24*a* and 24*b* of the driving body 21, by further moving the guiding portions 24*a* and 24*b* of the driving body 21 in the −Y direction, the first guided portion 32 is guided by the guiding portions 24*a* and 24*b* of the driving body 21, and moves in the +Z direction perpendicular to the −Y direction while sliding between the guiding portions 24*a* and 24*b* of the driving body 21. Also, the first guided portion 32 may be configured so that it contacts only the guiding portion 24*a*, which is one of the guiding portions 24*a* and 24*b* of the driving body 21, and moves in the +Z direction perpendicular to the −Y direction while sliding only on the guiding portion 24*a*.

By movement in the −Z direction of the first guided portion 32, the bell crank 30, which is connected to the first guided portion 32 via the first connecting pin 35, is rotated clockwise when viewed in the direction toward the space (−X direction, referring to FIG. 4) about the axis of the support pin 34. As the bell crank 30 rotates, force is transmitted to the second guided portion 33 in the −Z direction.

By transmitting the force in the −Z direction to the second guided portion 33, in the present embodiment, since the second guided portion 33 is in contact with the guiding portions 25*a* and 25*b* of the driven body 22, a force is transmitted from the second guided portion 33 to the guiding portion 25*a* of the driven body 22 in the −Z direction. Therefore, the guiding portions 25*a* and 25*b* of the driven body 22 further move in the −Z direction. At this time, the second guided portion 33 is guided by the guiding portions 25*a*, 25*b* of the driven body 22, and slides between the guiding portions 25*a*, 25*b* of the driven body 22, while moving vertically in the −Y direction perpendicular to the −Z direction. Further, the second guided portion 33 may be configured so that it contacts only the guiding portion 25*a*, which is one of the guiding portions 25*a* and 25*b* of the driven body 22, and moves in the −Y direction perpendicular to the −Z direction while sliding only on the guiding portion 25*a*.

Since the driven body 22 comprises guiding portions 25*a* and 25*b*, as the guiding portions 25*a* and 25*b* move further in the −Z direction, the driven body 22 similarly moves further in the −Z direction.

In the operation described above, focusing on the moving direction of the first guided portion 32, the first guided portion 32 moves in the −Z direction in the transition from the state in FIG. 3 to the state in FIG. 6, and it moves in the +Z direction in the transition from the state in FIG. 6 to the state in FIG. 7. Moreover, focusing on the moving direction of the second guided portion 33, the second guided portion 33 moves in the +Y direction in the transition from the state of FIG. 3 to the state of FIG. 6, and it moves in the −Y direction in the transition from the state in FIG. 6 to the state in FIG. 7.

In the action of pulling the rivet, by the action explained above, as the driving body 21 moves in the −Y direction within the corner head 20, the driven body 22 moves in the −Z direction, and as a result, the direction of the force that pulls the rivet is changed by 90 degrees.

Thus, from the start to the end of the operation within the corner head 20 shown in FIGS. 3, 6 and 7, the first guided portion 32 moves in a direction perpendicular to the moving direction of the driving body 21. Similarly, the second guided portion 33 moves in a direction perpendicular to the moving direction of the driven body 22. Further, the first and second guided portions 32 and 33 are supported and connected by the first and second connecting pins 35 and 36, respectively, and have rotational freedom, so that the bell crank 30 is able to continually maintain a fixed angular attitude.

Moreover, the present embodiment is configured so that, since the corner head is a corner head with which the angle is changed by 90 degrees, the moving direction of the second guided portion 33 is perpendicular to the moving direction of the first guided portion 32; however, in a corner head that performs an angle change of 120°, for example, the moving direction of the second guided portion is configured to be 120° with respect to the moving direction of the first guided portion.

Description of Reference Numerals: 10 Rivet tool, 20 Corner head, 21 Driving body, 22 Driven body, 23 Nose unit, 24 (24*a*, 24*b*) Guiding portion, 25 (25*a*, 25*b*) Guiding portion, 30 Bell crank, 31 Bell crank body, 32 First guided portion, 33 Second guided portion, 34 Support pin, 35 First connecting pin, 36 Second connection pin.

What is claimed is:

1. A corner head for a tool, the corner head comprising:
a driving body including a driving guiding portion;
a driven body including a driven guiding portion;
a bell crank including a first guided portion and a second guided portion; and
a support pin, wherein the bell crank is rotatable about an axis of the support pin,
wherein the first guided portion and the second guided portion are in slidable contact with the driving guiding portion of the driving body and the driven guiding portion of the driven body, respectively, the driving guiding portion is disposed on opposite sides of the first guided portion, and the driven guiding portion is disposed on opposite sides of the second guided portion, and
wherein when the driving body is moved in a first direction, the following occurs:
the first guided portion is guided by the driving guiding portion of the driving body and moves in a second direction perpendicular to the first direction;
the bell crank rotates about the axis of the support pin;
the second guided portion is guided by the driven guiding portion of the driven body and moves in a third direction different from the second direction; and
the driven body moves in a fourth direction perpendicular to the third direction.

2. The corner head according to claim 1, wherein the bell crank comprises a bell crank body, and the bell crank body is coupled to the first guided portion via a first connecting pin and to the second guided portion via a second connecting pin.

3. The corner head according to claim 1, wherein a first surface of the first guided portion is in slidable surface contact with the driving guiding portion of the driving body, and a second surface of the second guided portion is in slidable surface contact with the driven guiding portion of the driven body.

4. The corner head according to claim 1, wherein the first direction is perpendicular to the fourth direction.

5. The corner head according to claim 1, wherein the bell crank includes a bell crank body, and wherein the bell crank body, the first guided portion, and the second guided portion are a unitary piece.

6. The corner head according to claim 2, wherein the bell crank body partially defines a first slit and a second slit, the first guided portion and the second guided portion are octagonal, the first guided portion is rotatably mounted on the first connecting pin and in the first slit, and the second guided portion is rotatably mounted on the second connecting pin and in the second slit.

7. A rivet tool for setting a rivet, the rivet tool comprising a corner head, the corner head comprising:
a nose unit operable for insertion of the rivet to be set;
a driving body including a driving guiding portion;
a driven body including a driven guiding portion;
a bell crank including a first guided portion and a second guided portion; and
a support pin, wherein the bell crank is rotatable about an axis of the support pin,
wherein the first guided portion and the second guided portion are in slidable contact with the driving guiding portion of the driving body and the driven guiding portion of the driven body, respectively, the driving guiding portion is disposed on opposite sides of the first guided portion, and the driven guiding portion is disposed on opposite sides of the second guided portion; and
wherein when the driving body is moved in a first direction, the following occurs:
the first guided portion is guided by the driving guiding portion of the driving body and moves in a second direction perpendicular to the first direction;
the bell crank rotates about the axis of the support pin;
the second guided portion is guided by the driven guiding portion of the driven body and moves in a third direction different from the second direction; and
the driven body moves in a fourth direction perpendicular to the third direction.

8. The rivet tool according to claim 7, wherein the bell crank comprises a bell crank body, and the bell crank body is coupled to the first guided portion via a first connecting pin and to the second guided portion via a second connecting pin.

9. The rivet tool according to claim 7 wherein a first surface of the first guided portion is in slidable surface contact with the driving guiding portion of the driving body, and a second surface of the second guided portion is in slidable surface contact with the driven guiding portion of the driven body.

10. The rivet tool according to claim 7, wherein the first direction is perpendicular to the fourth direction.

11. The rivet tool according to claim 7, wherein the bell crank includes a bell crank body, and wherein the bell crank body, the first guided portion, and the second guided portion are a unitary piece.

12. The rivet tool according to claim 8, wherein the bell crank body partially defines a first slit and a second slit, the first guided portion and the second guided portion are octagonal, the first guided portion is rotatably mounted on the first connecting pin and in the first slit, and the second guided portion is rotatably mounted on the second connecting pin and in the second slit.

13. The rivet tool according to claim 7, wherein a pull angle of less than 180 degrees is defined between the nose unit and the driving body, and the support pin is located within the pull angle.

* * * * *